US010035616B1

(12) United States Patent
Hood et al.

(10) Patent No.: US 10,035,616 B1
(45) Date of Patent: Jul. 31, 2018

(54) EXIT CONTROL MECHANISM FOR REDUCING PROCESSING STATION ERRORS

(71) Applicant: Amazon Technologies, Inc., Reno, NV (US)

(72) Inventors: James Lamar Hood, Renton, WA (US); Charles Edward Rice, Bainbridge Island, WA (US); Ryan Stuart Carter, Seattle, WA (US); Henry Chi-Chung Yan, Seattle, WA (US); Michael Ellsworth Bundy, Seattle, WA (US)

(73) Assignee: Amazon Technologies, Inc., Reno, NV (US)

( * ) Notice: Subject to any disclaimer, the term of this patent is extended or adjusted under 35 U.S.C. 154(b) by 933 days.

(21) Appl. No.: 14/206,265

(22) Filed: Mar. 12, 2014

(51) Int. Cl.
*B65B 57/04* (2006.01)

(52) U.S. Cl.
CPC ..... *B65B 57/04* (2013.01)

(58) Field of Classification Search
USPC ..... 700/216
See application file for complete search history.

(56) References Cited

U.S. PATENT DOCUMENTS

| | | | | |
|---|---|---|---|---|
| 4,563,861 | A | 1/1986 | Barillec et al. | |
| 2006/0020366 | A1* | 1/2006 | Bloom | B07C 3/00 700/226 |
| 2015/0254604 | A1* | 9/2015 | Arora | G01G 19/40 705/332 |

FOREIGN PATENT DOCUMENTS

| | | |
|---|---|---|
| EP | 2631185 | 8/2013 |

OTHER PUBLICATIONS

U.S. Appl. No. 14/206,539, filed Mar. 12, 2014, James Lamar Hood.

* cited by examiner

*Primary Examiner* — Kyle O Logan
(74) *Attorney, Agent, or Firm* — Robert C. Kowert; Meyertons, Hood, Kivlin, Kowert & Goetzel, P.C.

(57) ABSTRACT

Systems and methods for an exit control mechanism indicating an incomplete packing state near an exit portion of a packing station. A control system determines a pack job and determines a pack plan for the pack job. The control system may send instructions to a pack station directing packing of the pack job in accordance with the pack plan. The control system may receive indications of packing progress, for example, electronic indications from a scanner at the pack station, and update the state of the pack job, such as incomplete or complete. The control system instructs an exit mechanism to change from indicating an incomplete pack state to indicating a completed pack state based on, for example, determinations that the steps of the pack plan have been completed correctly and that the pack job is complete.

20 Claims, 8 Drawing Sheets

EXIT CONTROL MECHANISM FOR REDUCING PROCESSING STATION ERRORS

BACKGROUND

Manufacturers, distributors, retailers, and other processing entities with facilities (which may collectively be referred to as materials handling facilities) typically receive; process and send (e.g., sell) materials. For example, retailers, wholesalers, and other product distributors (which may collectively be referred to as distributors) typically order, receive and maintain an inventory of various items that may be ordered by clients or customers for delivery.

A control system in a materials handling facility may direct agents to pick items from inventory to fulfill customer orders for the items. The agents may place the picked items on a conveyance mechanism that transports the items to various processing stations, such as a sort station or area where items may be sorted into orders and/or to pack stations or areas where items may be packed into shipping containers.

Agents at the pack stations that pack items into shipping containers may select a particular size shipping container from a location in the pack station where it is stored. The agent may build the shipping container and scan various identifiers associated with the shipping container and items being placed into the container as the agent packs the items into the shipping container. Packing software may monitor the packing process (e.g., via the scanning activity) such that errors may be detected in the packing process. However, the packing process, error detection, and error notification may be performed in such a manner that detected errors are brought to the attention of the agent only after the agent has lost the ability to correct the error.

For example, agents may be incentivized to perform the packing process quickly. In some cases, agents may ignore cues or instructions that are supplied for packing a container (e.g., instructions provided on a display at the pack station) and instead may rely upon their own knowledge or other cues at the pack station to perform the pack process. For instance, agents may instead rely upon the order the items arrive at the pack station or rely upon the arrangement of the items in a receptacle received at the pack station to determine what items to pack into a container. In some of these instances, for example when the sortation was incorrect, packages may be packed incorrectly despite displayed instruction that could have resolved the error and the package may be sent from the pack station before the error is detected.

In another example, the packing process itself may be such that certain types of errors may not be detected until after the package has left the packing station. Some packing error detection systems may rely upon receiving indications from scanners at the pack station that indicate a step in a packing process has been performed. For instance, a packing error detection system may include logic that waits for an indication that a packing process for the next package has begun (e.g., scan information from another shipping container) before inferring or determining that the received indication suggests that the prior package must have been sent from the pack station. Such packing error detection logic cannot indicate an error such as incomplete packing until the pack process for the next shipment has begun and the previous package has already left. Correcting errors at a pack station with such logic can be difficult, if not impossible.

Figure 1:
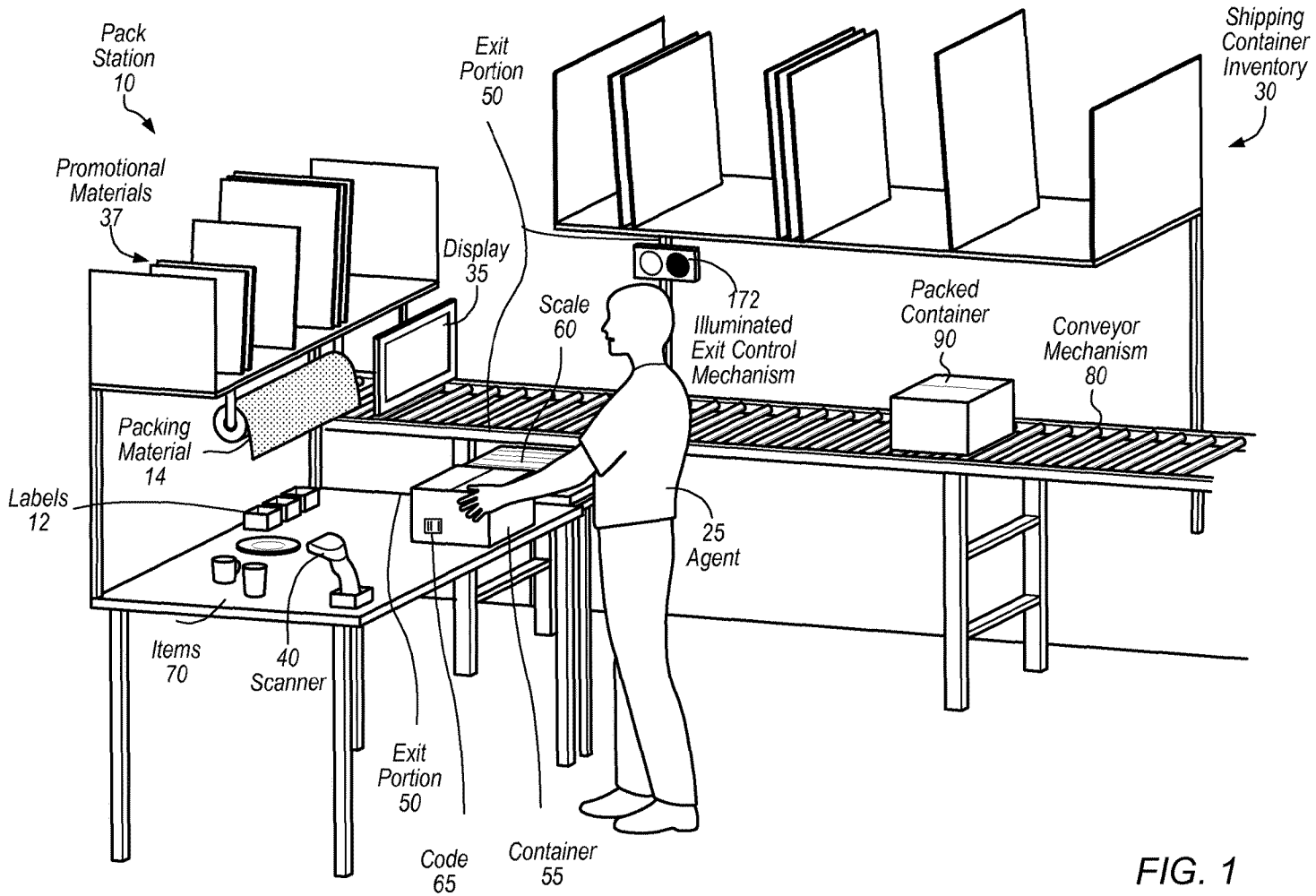
FIG. 1 illustrates a pack station with an exit control mechanism, according to some embodiments.

While embodiments are described herein by way of example for several embodiments and illustrative drawings, those skilled in the art will recognize that the embodiments are not limited to the embodiments or drawings described. It should be understood, that the drawings and detailed description thereto are not intended to limit embodiments to the particular form disclosed, but on the contrary, the intention is to cover all modifications, equivalents and alternatives falling within the spirit and scope as defined by the appended claims. The headings used herein are for organizational purposes only and are not meant to be used to limit the scope of the description or the claims. As used throughout this application, the word "may" is used in a permissive sense (i.e., meaning having the potential to), rather than the mandatory sense (i.e., meaning must). Similarly, the words "include," "including," and "includes" mean including, but not limited to.

DETAILED DESCRIPTION OF EMBODIMENTS

In a materials handling facility (e.g., a distribution facility), multiple, different product items may be stored together in a single inventory area, such as a shelf, rack, bin, or drawer. For example, a facility may store items such as books, CDs, DVDs, electronic devices, clothing, toys, hardware, materials, and/or other items together in various combinations within each inventory area. Items may be stored in inventory areas by an agent, either randomly, pseudo-randomly or according to one or more guidelines, with an inventory area selected for each item automatically, such as by software executing on a control system, in some embodiments.

A control system of a materials handling facility may direct agents to pick items from inventory to fulfill customer orders for the items. The agents may place the picked items on a conveyance mechanism that transports the items to various processing stations, such as a sort station or area where items may be sorted into orders and/or to pack stations or areas where items may be packed into shipping containers.

A control system may create and maintain a virtual picture of a facility. A virtual picture may track any number of objects and processes. A few examples include what items are in the facility, how many and where the items are, how many are expected to arrive and when as well as how many are expected to ship and when. Other examples include where containers are, how many and what items a container holds. The virtual picture may be updated by the control system. For example, the virtual picture may be maintained as entries in a database and the entries may be updated, based on data received from scanners, for example. The virtual picture may track the various processes that are being performed within the facility and where the items and containers are located in the facility with respect to the various processes. Example processes include receiving, stowing, picking, sorting, packing and shipping, as described herein, but may also include other processes.

Some of the processes may be performed at particular locations or stations within a facility. For example, a receiving process may be performed in a receiving area, a stowing process and a picking may be performed in an inventory area, sorting may be performed at a sorting station and packing may be performed at a packing station. Many of the embodiments described herein are described in the context of a packing station. However, at least some of the features described are also applicable to other types of stations for performing other types of processes. For example, a pack station may be configured with an exit control mechanism that indicates a particular state of a container being packed at the pack station.

In some embodiments, a pack plan that identifies a sequential multi-step packing process to be performed at a pack station is determined. In some embodiments, an indicator-enabled control system determines a pack job and determines a pack plan for the pack job. While one or more steps of the particular pack plan remain incomplete, the control system may instruct the exit control mechanism at the pack station to indicate that the particular pack plan is incomplete. For example, an illumination-enabled exit control mechanism may illuminate a red color at or near an exit point of a pack station while any steps of the particular pack plan remain incomplete and may illuminate in a green color when the steps are all complete. Such an exit control mechanism may be applicable to other types of stations, such as a sort station, for example.

In some embodiments, a pack station may also, or alternatively, include indicators for various work functions associated with the pack station. An indicator-enabled control system determines a pack job and determines a pack plan for the pack job. The indicator-enabled control system may send instructions to the pack station instructing indicators of the pack station to indicate the sequence of steps of a particular pack plan. The pack station may be configured to sequentially indicate the sequence of processing steps, for example via indicators (e.g., illumination-enabled indicators) placed near-to various locations or work functions of the pack station, in some embodiments.

In one example, an indicator-enabled system may comprise a control system and any number of variously configured devices used to determine the state of a container of items (e.g., scanners or other communication devices that obtain the data) and to instruct an exit mechanism of the station to indicate the state to an agent performing a process at the station. In some embodiments, the processes disclosed herein at the direction of the pack state-determining control system may be practiced in addition to or in place of other processes (e.g., displaying corrective instructions on a display screen at the station).

Various processes are disclosed associated with prominently-located off-screen indicators for reducing processing station errors prior to work items leaving the processing station. FIG. 1 illustrates a pack station with an exit control mechanism, according to some embodiments. Pack station 10 is illustrated with an illuminated exit control mechanism 172 near exit portion 50. In some embodiments, an agent 25 selects a shipping container from shipping container inventory 30. For example, the agent 25 may decide, based on observation of the items 70 to be packed, what size container to use. In another example, an agent 25 may receive instructions for which container to use from a display screen 35 located at the station. The agent 25 may select a container 55 from container inventory 30 and build the container, for example, folding the container into a box shape, taping the box and placing an identification code on the box. The agent 25 may scan the code 65 with a communication device (e.g. scanner 40) that sends an indicator of the scanned code to a control system or data store.

In embodiments, the control system may include, or may be used in conjunction with one or more hand-held, mobile and/or fixed readers, scanners (e.g., scanner 40) or scanning devices that may be able to scan, receive, or otherwise detect identifiers, marks or tags (e.g., bar codes, radio frequency identification (RFID) tags, etc.) on individual items (units), collections of items (e.g., cases), conveyance receptacles and/or facility locations (e.g., inventory areas, pack or sortation stations, particular locations within a pack station, etc.). An identifier of the item may include an item's inventory identification number, Universal Product Code (UPC), Stock-Keeping Unit (SKU) code, model number, version number and/or other designation (including proprietary designations), according to various embodiments.

Scanners may communicate with the control system to, for example, determine and record the item and/or type of items and/or a location within the facility. For example, an agent may scan an identifier of an item (e.g., using a handheld communication device such as a code scanner that sends the scanned code to the control system) when packing an item such that the control system is made aware that the item has been packed. In such embodiments, the control system may send an indication to the agent that the correct item was or was not packed by sending the indication to a communication device (e.g., the scanner) and/or to a display device to be presented to the agent. In another example, the agent may scan an identifier associated with a location or process of a pack station such that the control system is made aware of the performance of an action (e.g., a warning label being placed onto a shipping container) associated with the location (e.g., the location of a box of warning labels).

As illustrated in FIG. 1, the agent 25 may place items 70 of an order into the container 55. For example, the agent 25 may use her judgment to pack the items of the shipment or may rely upon instructions from a display 35 at the pack station 10 to pack the container 55 with the items 70. In some embodiments, the agent 25 may scan each item before placing the item in the container 55. In some embodiments, a control system may receive the scan information and send updated instructions to the display 35, according to a pack plan, for example.

The agent 25 may continue packing the container 55, for example, with packing material 14, labels (e.g., warning labels) 12, promotional material 37 and the like, according to instructions or otherwise. In some embodiments, scan information or other types of information, such as the package weight received from the scale 60 of the station may be used by the control system to provide feedback to the pack station regarding progress of the pack job. For example, a shipment 55 may be weighed by a scale 60 as it is packed and the additional weight of each item may be used to verify the order in which the items are packed. In some embodiments, the scale may be near an exit portion 50 of the pack station.

The exit portion 50 of the pack station 10 may be an area where packed containers 90 leave the pack station 10 or transition to a conveyance mechanism 80 that transports packed packages 90 away from the pack station 10. In some embodiments, the exit portion 50 of the station is a portion of the station associated with the area of movement of a packed shipment being moved from the pack station 10 to a conveyance that moves the shipment away from the pack station. In some embodiments, the exit portion 50 may include or be defined as a location where an agent is looking or has the agent's eyes trained at the end of the pack job, for example, when the agent moves a packed shipment from the pack station to a conveyor that moves the packed shipment away from the pack station. In some embodiments, a completion portion of the pack station may be an area of the pack station where the pack job is completed (e.g., where the packed container is moved away from the station, where a final step of the pack plan is performed such as adding packing material, etc.). FIG. 1 illustrates that the exit portion 50 may include an area surrounding, near-to or part of conveyor mechanism 80, such as where the illuminated exit control mechanism 172 is located in FIG. 1. In some embodiments, exit portion 50 may be an interface area between the pack station 10 and the conveyor mechanism 80.

In some embodiments, the exit control mechanism may be part of the fixtures that make up the pack station. For example, illuminated control mechanism 172 may be placed under a transparent portion of the table or workspace of the pack station such that illumination from the mechanism 172 can be seen through the transparent portion by the agent 25 as the agent is packing the container. In other embodiments, a focused beam of light may be projected in or near the exit portion 50. These and other configurations may facilitate error reduction for agents that work so quickly that they pass packed shipments to conveyor 80 without looking towards conveyor 80.

In some embodiments, one or more audible signals may be used to convey a message to the agent of the pack station. Different types of audible signals, for example audible signals of different sound, tone, length, etc. may be used to signal different messages. In some embodiments, a sensor may monitor a plane between the pack station and the conveyor 80 such that when the plane is broken, for example by a package passing through the plane, the sensor senses the package. The control system may receive an indication of the plane being broken from the sensor and send an instruction to an audible device (e.g., a speaker) to emit an audible signal or sound, such as a tone that can be heard by the agent. In some embodiments, the sound may indicate the packed shipment is incomplete or that there has been some error (e.g., an unpleasant sound), while in some embodiments, the sound may indicate the packed shipment is complete (e.g., a pleasant sound). In some embodiments, different sounds may indicate or be associated with different locations of the pack station.

An illuminated exit control mechanism 172 may be positioned or located within, at or near-to the exit portion 50 of the pack station 10. In some embodiments, the illuminated exit control mechanism 172 indicates a state of the pack job. For instance, the illuminated exit control mechanism 172 may be instructed to indicate that the state of the pack plan for the package 55 being packed is in an "incomplete" pack state, based on the weight or scan information, for example. The illuminated exit control mechanism 172 may be instructed to switch to indicating a different state such as a "go" pack state, for example, when the state of the pack plan for the package 55 being packed is complete. Various other states may be indicated in various embodiments and the exit control mechanism may take any of various forms, such as a light, a gate or a conveyor, for example.

The illuminated exit control mechanism 172 may be positioned such that the state being indicated is unavoidably visible to the agent 25. For example, an agent 25 may sometimes pack a shipment without looking at an instruction screen located at the pack station 10. In some such instances, packing errors may be made by the agent 25, recognized by the control system and displayed on the display to the agent. However, because the agent 25 is able to perform at least some of the pack processing without looking at the display screen, the agent 25 may not observe the error or corrective action displayed on the screen. In some embodiments, the illuminated exit control mechanism 172 may be located at the exit portion 50 of the pack station 10 such that the state indicated by the illuminated exit control mechanism 172 is unavoidably indicated to the agent, even when the agent is performing the packing process without looking at the instructions on the display screen. In some embodiments, the location of the illuminated exit control mechanism 172 at the exit portion of the pack station is such that the state indicated by the exit control mechanism is unavoidably indicated to the agent 25 as the agent 25 completes packing the container 55 and turns to move the packed container 55 to the conveyor mechanism 80, via the exit portion 50.

An exit control mechanism may indicate a particular state in a number of ways. For example, an illuminating exit control mechanism may illuminate one particular color to indicate one particular state (e.g., an incomplete state) while illuminating another particular color to indicate another state (e.g., a go pack state). In some embodiments, an exit control mechanism may be configured to indicate other states (e.g., partial completion, error state, etc.). In addition to, or instead of, a light-based mechanism, a gate-type exit control mechanism may indicate one state when the gate is configured in one position (e.g., interfering with movement of the package from the pack station) and indicate another state when the gate is configured in another position (e.g., not interfering with movement of the package from the pack station). Another type of mechanical exit control mechanism, a conveyor-type exit control mechanism may indicate a particular state (e.g., an incomplete state) when the conveyor is not conveying and another state (e.g., a go pack state) when the conveyor conveys the packed package away from the packing station. Other types of exit control mechanisms are contemplated in addition to the examples given for purposes of illustration.

Figure 2:
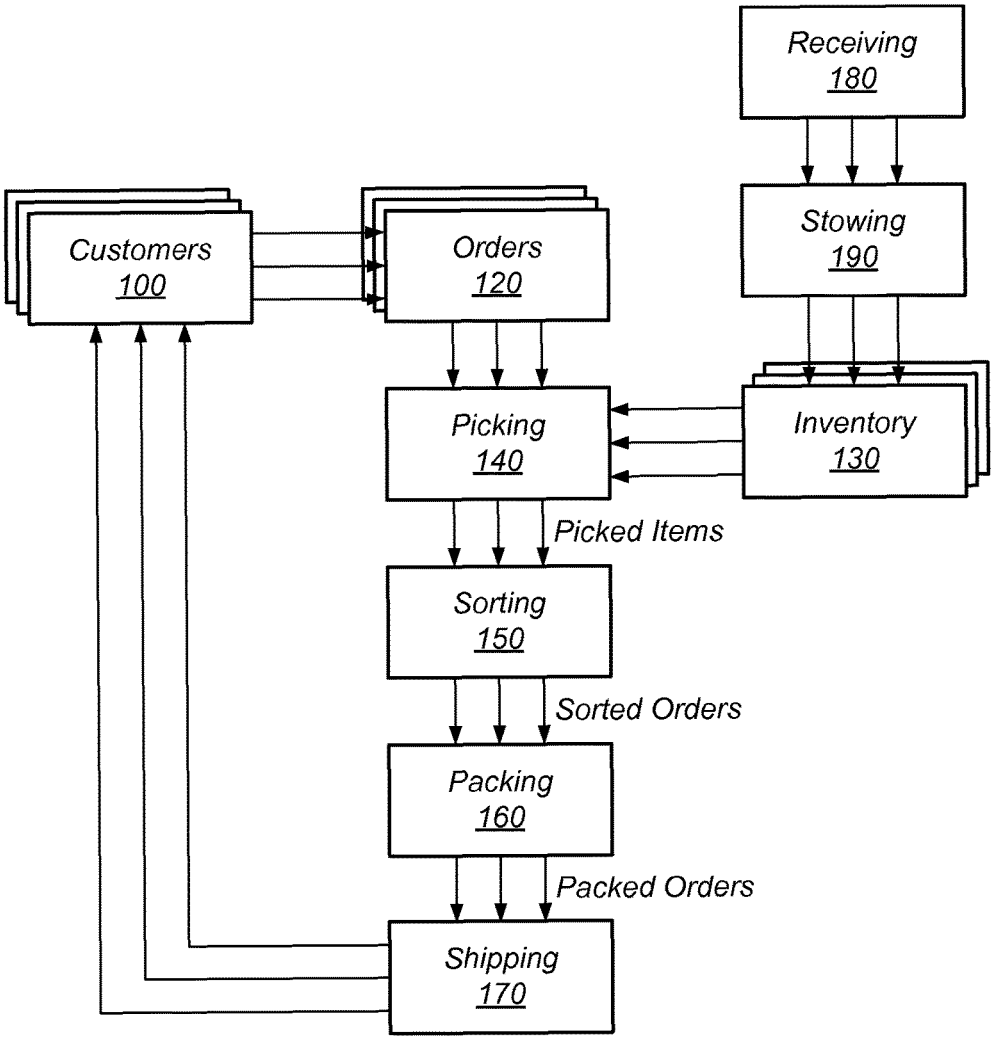
FIG. 2 is a flow diagram that illustrates relationships between objects and processes of a materials handling facility, according to some embodiments.

A distribution facility or other materials handling facility may include an inventory management system employing an indicator-based error reduction system in various operations of the facility. FIG. 2 illustrates a broad view of the operations of one such facility, which, in one embodiment, may be configured to utilize an indicator-based error reduction management system as described herein. In this example, multiple customers 100 may submit orders 120 to the distributor of the items in the facility, where each order specifies one or more items from inventory 130 to be shipped to the customer that submitted the order. To fulfill the customer orders 120, the one or more items specified in each order may be retrieved or "picked" from inventory 130 (which may also be referred to as stock storage) in the order fulfillment facility, as indicated at 140. In some embodiments, agents may identify inventory locations in inventory 130 for performing operations, as described herein. Picked items may be delivered to one or more stations in the order fulfillment facility for sorting 150 into their respective orders, packing 160, and finally shipping 170 to the customers 100. Various embodiments may implement the system for reducing processing station errors via prominently-located off-screen indicators to facilitate packing packages by determining packing errors and directing an exit control mechanism to indicate the packing error. A picked, packed and shipped order does not necessarily include all of the items ordered by the customer; a shipped order may include only a subset of the ordered items available to ship at one time from one inventory-storing location.

An order fulfillment facility typically also includes a receiving operation 180 for receiving shipments of stock from various vendors and a stowing operation, illustrated as stowing 190, for placing the received stock into stock storage (inventory 130). In some embodiments, stowing 190 may involve stowing an item in a location within inventory 130 selected by a control system (e.g., randomly, pseudo-randomly, or according to various guidelines for stowing similar or different items within the facility). In some embodiments, stowing 190 may involve scanning the item and/or the inventory location when adding items to one of the plurality of inventory areas in inventory 130.

A system for reducing station errors, as described herein, may be utilized in a number of different facilities and situations, including, but not limited to material handling facilities, order fulfillment centers, rental centers, distribution centers, packaging facilities, shipping facilities, libraries, museums, warehouse storage facilities, shopping centers, grocery stores, car parking lots, etc. In general, a system for a system for reducing processing station errors via prominently-located off-screen indicators may be used in any situation in which a process is performed on an item at a station and then the item is directed from the station.

A system for reducing processing station errors via conspicuously (or unavoidably) located off-screen indicators as described herein in various embodiments, may be utilized in several areas of a materials handling or order fulfillment facility such as, but not limited to sorting 150, packing 160, and shipping 170. For example, in some embodiments, a system for reducing processing station errors via conspicuously located off-screen indicators may receive information about items during sorting 150, packing 160 or during shipping 170 (e.g., labeling) and send the information to a control system that may determine an error state and instruct a mechanism (e.g., an exit control mechanism) to indicate the state. Any or all of these processing areas may include scanners to track the progress of an item and thus may be used to determine that an error in processing has occurred.

The arrangement and order of operations illustrated by FIG. 2 is merely one example of many possible embodiments of the operation of a facility that implements a system for reducing processing station errors via prominently-located off-screen indicators. Other types of materials handling, manufacturing, or order fulfillment facilities may include different, fewer, or additional operations and resources, according to different embodiments.

Figure 3:
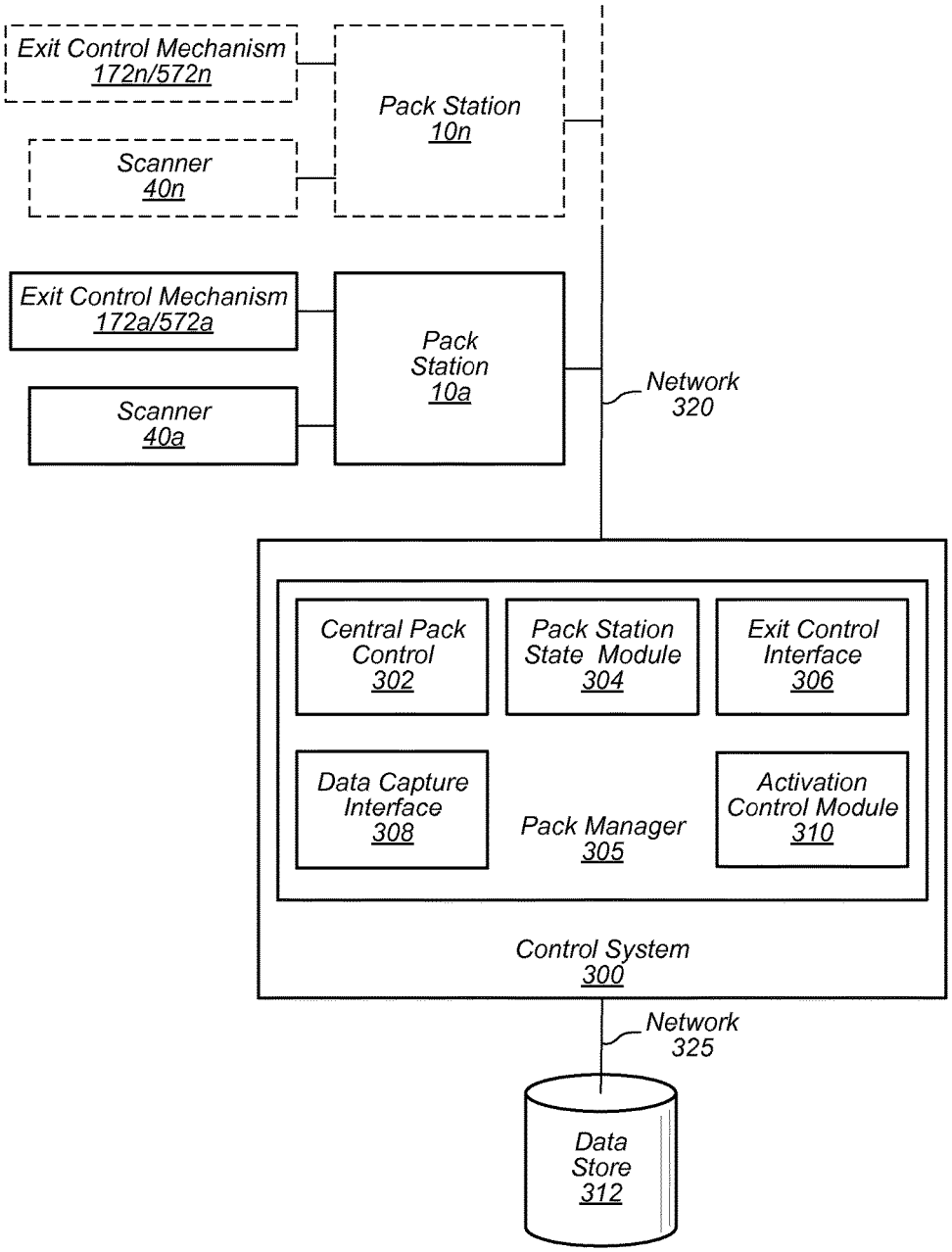
FIG. 3 illustrates a high-level schematic of a control system and one or more pack stations of a materials handling facility, according to some embodiments.

The various systems and stations of a materials handling facility may be arranged in many different configurations, according to various embodiments. For example, an order fulfillment facility may implement an order fulfillment control system, or control system for short, as part of its overall inventory management system. A control system (such as illustrated in FIG. 3 and described below) may include hardware and software configured for assisting and/or directing agents in the materials handling facility in receiving items into the fulfillment center fulfilling customers' orders. For example, in some embodiments, such a control system may transmit information such as instructions to communications devices, which may display or otherwise indicate the instructions and other information to an agent (e.g., a stowing, picking, sorting or packing agent).

After obtaining items from primary inventory or from the receiving area 180, picking agents may transfer those items to sorting stations, according to one embodiment. Not every facility includes both sorting and packing stations. In certain embodiments, agents may transfer picked items directly to a packing station, and the picked items may be directed to a particular packing station by a control system (e.g., control system 300, in FIG. 3). In other embodiments, agents may transfer picked items to a combination sorting and packing station (not illustrated). This may result in a stream and/or batches of picked items for multiple incomplete or complete orders being delivered to a sorting station for sorting into their respective orders for packing 160 and shipping 170, according to one embodiment. Portions of an order may be received at different times, so sorting 150 and packing 160 may have to wait for one or more items for some orders to be delivered to the sorting station before completion of processing of the orders. A stream or batches of incoming picked items may be sorted into their respective orders at the sorting station(s). While, in some embodiments, automated sorting may be utilized, such as through the use of Crisplant® or Eurosort® sorters, in other embodiments sorting may be performed manually. In yet other embodiments, both manual and automatic sorting may be used in combination. Once an order is completed at a sorting station, the order may be ready to proceed to a packing station to be packaged for shipping 170.

Items in inventory 130 may be marked or tagged with a bar-code, radio frequency identification (RFID) tag, Universal Product Code (UPC), Stock-Keeping Unit (SKU) code, serial number, and/or other designation (including proprietary designations) to facilitate materials handling facility 205 operations, including, but not limited to, stowing 190, picking 140, sorting 150 and packing 160. These designations, or codes, may identify items by type, and/or may identify individual items within a type of item. The control system may also include, or may be used in conjunction with, handheld, mobile and/or fixed scanners or scanning devices that may be able to scan the marks or tags on individual items and/or inventory areas to determine and record an identifier of an item or container and/or an item or container location. In some embodiments, a control system may be configured to access location, position and/or descriptive information for items (e.g., from a product database or other data store) and may provide this information to agents along with other information indicating items to be packed, as will be described in more detail below. Inventory locations may also be marked with similar codes.

A materials handling facility may include a control system with various components for receiving, processing and sending data. The control system may communicate with communication devices in the facility, such as scanners at one or more stations in order to determine various states of processes being performed at the stations or states of packages or items and to instruct devices such as display devices, automated equipment and illumination devices to indicate the state. For example, FIG. 3 illustrates a high-level schematic of a control system and at least one pack station of a materials handling facility, according to some embodiments.

A materials handling facility, such as a distribution facility may implement an error-reduction control system, or control system for short, as part of its overall inventory management system. A control system (such as illustrated in FIG. 3 and described below) may include hardware and software configured for assisting and/or directing agents and/or devices in the materials handling facility in managing inventory and fulfilling customers' orders. For example, in some embodiments, such a control system 300 may receive information, such as inventory information from data store 312 and transmit information such as instructions to communications devices (e.g., display 35 or scanner 40) which may display the instructions and other information to a sorting agent or a packing agent 25 or may instruct automated devices to direct items to various areas of the facility. In some embodiments, scan information from communication devices (e.g., scanner 40) may be sent to the control system 300. In some embodiments, the control system may use the scan information to make determinations, such as whether a step of a sequential-multi-step process has been performed. The system may use rules, logic, and the like to determine whether the scan information indicates, suggests, or implies that the step has been performed. The rules or logic may be implemented as software code, executable by one or more computing processors, for example.

In some embodiments, control system 300 may include pack manager 305 for managing pack stations at the facility. For example, pack manager 305 may receive or determine pack jobs and communicate with various other modules of the control system in order to instruct performance of and track the state of the pack job. In some embodiments, pack manager 305 may communicate with other components or services of the control system (e.g. an ordering system that receives orders or a data store that stores orders) in order to determine pack jobs. For example, the central pack control 302 may receive a pack job for a shipment from an ordering system and determine a pack plan for the shipment. A pack plan may include a sequence of steps, such as selecting a recommended container for packing the shipment, one or more steps associated with packing the items into the recommended container, selecting the packing material to use, warning labels to apply to the container and the like.

In some embodiments, the central pack control may determine which of a plurality of pack stations (10*a* . . . 10*n*) the pack job will be assigned to. In some embodiments, the assignment may be determined by the capabilities or configuration of the pack station or which pack station is available to perform the pack job. The central pack control 302 may send a message to pack station state module 304 indicating the assigned station and the pack job. The pack station state module 304 may responsively record that the station is assigned to the pack job and track the state of the pack station 10*a* as the pack job is processed by the station as well as direct the pack station 10*a* to indicate a pack state. For example, data capture interface 308 may receive indications of the performance of one or more steps of the pack plan from the pack station 10*a*. In some embodiments, the steps are captured via a scanner used by an agent at the pack station and sent to the control system. An agent may use a scanner to scan a shipping container, the items being placed into the container, the type of packing material being used by the agent to pack the shipment, etc. The codes scanned by the scanner may be sent to the control system and deciphered to determine what steps of the pack plan have been performed, in what order, and whether any errors have occurred.

A data capture interface 308 may receive indications of the scanned codes and pass the indications of the scanned codes to the pack station state module 304 or the data store 312. Pack station state module 304 may interpret or analyze the indications of the received scan data against the pack plan to track progress of the pack station processing and to determine if any errors have occurred. For example, the pack station state module 304, upon receiving the pack plan and the pack station from central pack control, may send a message to the exit control interface 306 of the control system, instructing an exit control mechanism 172/572 of a particular pack station to indicate an incomplete pack state. The exit control interface 306 may send instructions to the exit control mechanism 172/572 of the pack station 10*a* instructing the exit control mechanism 172/572 of the pack station 10*a* to indicate the instructed state.

In some embodiments, activation control module 310 may receive instructions from pack station state module 304 or central pack control 302 to control activations of indicators at the pack station. For example, various areas, features, objects or other parts of the pack station may be configured with indicators near-to, at, on or indicative of the locations of the various areas, features, objects or other parts of the pack station. In some embodiments, the station may be configured such that activation of one of the indicators conveys an instruction to perform some step of the pack plan associated with a particular one of the various areas, features, objects or other part of the pack station. An operator may perform the indicated step and scan a code associated with the indicated step, with scanner 40, for example. Receipt of an indication of the scanned code associated with the performed step may be received by the control system such that the pack station state module 304 may determine and record whether the step was performed correctly or at all. In some embodiments, an error may be indicated when unexpected data (e.g., when compared with the instructed step) is received or if the system times out without receiving any data within an expected time period. In some embodiments, moving the pack station interface off a display screen and onto the various portions of the pack station associated with the instructed steps in the described manner may improve station processing accuracy and efficiency.

Scanner 40*a* may send and/or receive information to/from control system 300 via the network 320. For example, the scanner data capture device 40*a* may be used to scan item or container information and may send the scanned information to a service or a data store (e.g., data store 312). In another example, an automated communication device may automatically scan items or containers as they travel by on a conveyance mechanism. In some embodiments, a communication device may take the form of a button associated with a location of the station or step of the process that an agent presses when a particular action is performed.

Data store 312 may be any of various configurations recognized by one of skill in the art. In various embodiments, such a data store may be configured as a database, as one or more mass storage devices (e.g., physical disks, logical volumes, etc.) configured to store data blocks or files, or in any other suitable configuration for data storage. In one example, data store 312 may comprise a data store that is local to the facility and in another example, data store 312 may be part of an (e.g., remote to the facility or control system) enterprise data store that stores data for an enterprise controlling multiple facilities. Data store 312 is illustrated as communicatively connected to control system 300 via network 325.

In various embodiments, networks 320 and 325 may encompass any suitable combination of networking hardware and protocols necessary to establish communications between the control system 300 and the pack station(s) and the data store 312, respectively. For example, a materials handling facility may be provisioned within enterprises having their own internal networks. In such an embodiment, networks 320, 325 may include the hardware (e.g., modems, routers, switches, load balancers, proxy servers, etc.) and software (e.g., protocol stacks, accounting software, firewall/security software, etc.) necessary to establish a networking link between pack station 10*a* and control system 300 as well as between data store 312 and the control system 300.

An application programming interface (API) or other messaging interface between the pack stations and the control system may provide any level of interoperation between the two. For example, the control system 300 and pack station 10 may share varying degrees of control logic. In some embodiments, pack station 10 may be configured with very little to no logic, such that the pack station relies upon control system 300 for performing any or most logical operations and instead responds to basic commands from the control system 300. For instance, control system 300 may be programmed with or may have access to (e.g., via data tore 312) the particular locations of indicators in pack station 10 such that the control system may directly send each individual indicator an instruction to activate and de-activate. In other embodiments, for example when the pack station is configured to perform some of the logical operations in place of the control system 300, the pack station may be configured (e.g., via API) to receive an overall pack plan from the control system and determine which indicators to activate based upon the pack plan, without direct instruction from the control system. Such configuration may be useful for systems that include multiple types of pack stations, such that the control system can send one format of pack plan to any type of pack station in the system, and the different pack stations can interpret and sequentially indicate the pack plan in accordance with the particular pack station configuration.

In some embodiments, a defined messaging interface may be configured to pass messages among the devices of the pack station and various portions of the control system, in response to events and to notify devices of events, for example. In some embodiments, a module of the control system 300 (e.g., pack station state module) may send out an event indicating instruction of the next step in the pack plan. Another module of the control system 300 (e.g., activation control module 310) may be configured to wrap the controller for the indicators such that the other module picks up the event and signals that indicator to activate or de-activate in accordance with the event.

Figure 4:
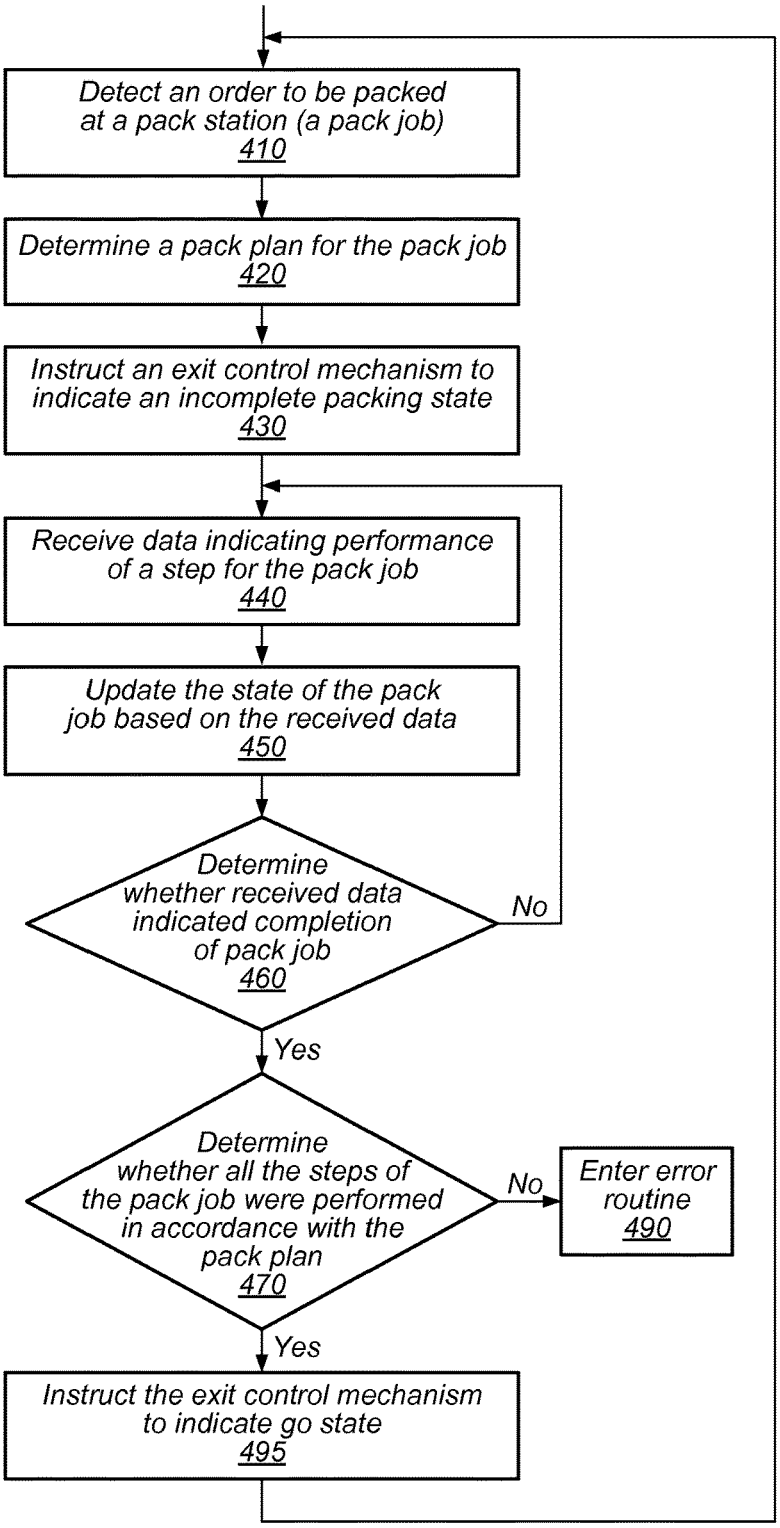
FIG. 4 illustrates a process chart describing a process for determining and indicating a state of a packing station, according to one embodiment.

A materials handling facility may include various processes associated with processing materials in the facility. For example, a materials handling facility may include various stations for performing processes associated with fulfilling order placed by customers of the facility. FIG. 4 illustrates a process chart describing a process for determining and indicating a state of a packing station 10*a*, according to one embodiment. In particular, FIG. 4 illustrates a process for determining whether a pack job has been completed correctly and instructing an exit control mechanism (e.g., exit control mechanisms 172/572) to indicate that the pack job has been completed correctly or not. The various portions of the illustrated process may be performed by various components of a control system (e.g., control 300) for a materials handling facility, in some embodiments.

At block 410, an order to be packed at a pack station may be detected. For example, the pack manager 305 may receive instructions from an order management system to pack an order for shipment. In another example, the pack manager 305 may detect that the pack station is performing a pack plan, by receiving data via the data capture interface 308, for example. In some embodiments, an order to be packed may be referred to as a pack job.

Block 420 illustrates that a pack plan for the pack job may be determined. In some embodiments, the central pack control may determine the pack plan or obtain the pack plan, from data store 312, for example. In one example, central pack control may determine a pack plan that includes a sequence for packing the order, for example, selecting a shipping container, packing the items of the shipment into the container, adding the packing material, and applying a label. At block 430, an exit control mechanism may be instructed to indicate an incomplete packing state. For example, pack station state module 304 may send an instruction to exit control mechanism 172/572 via exit control interface 306 to indicate an incomplete packing state. In some embodiments, the exit control mechanism may continue to indicate an incomplete pack state until directed by the control system to indicate a go pack state (e.g., when packing of the shipment is complete and the shipment is ready to leave the pack station).

At 440, data indicating performance of a step for the pack job may be received. For example, an indication of scanned information captured by scanner 40*a* of the pack station 10*a* may be sent to the data capture interface 308 that may store the indication (e.g., in data store 312) or forward the indication to the pack station state module 304. The received data may indicate either that an expected step was performed as expected, indicated or directed or that another step other than the expected, indicated or directed step was performed.

At block 450, a state of the pack job may be updated, based on the received data. For example, if the received data indicated that an expected step was performed, the state may be updated to indicate the step was performed. For instance, if the control system received an indication that the first of three items was packed for the shipment, the pack station state module may update the state of the pack job to indicate the first item was packed, for instance. In another example, if the received data indicated that a different step then the expected step was performed, or if no data was actually received from the pack station in a certain amount of time, the status may be updated to indicate non-performance of the expected step.

Block 460 illustrates that a determination may be made whether the received data indicated the pack job is not completed. For example, pack station state module 304 may receive data from data capture interface 308 and determine that the received data indicates completion of the pack job, or the pack station state module 304 may simply read the current state that was updated at block 450. For example, the pack station state module may receive a code scanned from a shipping container and determine that a new shipping container has been selected by the agent at the station and thus, the prior shipping container has been sent away from the packing station 10*a*. If the received data did not indicate completion of the pack job, then the process may return to block 440, where the pack manager may wait to receive data indicating performance of a step for the pack job, and so on. If the received data did indicate completion of the pack job, the process may continue to block 470, where a determination of whether all the steps of the pack job were performed in accordance with the pack plan may be made.

In another example, pack station state module 304 may receive an indication that the last item of the pack plan has been scanned and logic of the pack station state module 304 may determine that receipt of the indication of the final item corresponds with the order of the pack plan. The exit control mechanism (e.g., exit control mechanisms 172/572) may then be instructed to indicate a go pack state (by pack station state module 304, via exit control interface 306) when the pack job is determined complete, as at 495.

In some embodiments, the pack station state module 304 may receive the indication from data capture interface 308 and analyze the indication to determine if the step of the packing plan was performed. For example, a packing plan may include a sequence of steps such as selecting a shipping container, packing the items into the container, adding a label, etc. and the pack station state module may compare the order of received scan indications to determine if the order of the received indications corresponds with the order of the pack plan. In another example, pack station state module may be configured with logic that expects to receive an indication of a particular size container at the start of the pack process.

Packing Error Handling

At 490, an error routine may be entered into when it is determined that an indicated performance was not performed in accordance with the pack plan. For example, pack station state module 304 may determine that a received indication from pack station 10*a* indicates that the wrong shipping container has been selected or that the items have been packed in the wrong order or that an item is missing. In some embodiments, packing errors may be handled by pack station state module 304 or central pack control 302, for example. In some embodiments, error control logic in the pack manager 305 may respond to an error with inaction (e.g., leaving the exit control mechanism in the incomplete state) or may take some form of corrective action. For example, error control logic in pack station state module 304 may recognize an error and determine (e.g., via rule set stored in the data store 312) a solution to the error. Pack station state module 304 may send instructions (e.g., instructions associated with corresponding rules from the rule set and stored in data store 312) indicating the solution to the pack station, via a display screen at the pack station, via an audio prompt, or via illumination of an illumination device associated with the solution, for example. Subsequently-received scan information may be used by the pack station state module to determine that the error has been resolved and the process may continue by returning as illustrated at block 440, or otherwise.

Block 495 illustrates that if all the steps of the pack job are determined performed in accordance with the pack plan, the exit control mechanism may be instructed to indicate a go pack state. For example, exit control interface may send an instruction to exit control mechanism 172/572 instructing the mechanism to indicate a go pack state. In some embodiments, illuminated control mechanism 172 may change from displaying a red color to displaying a green color or gated exit control mechanism 572 may lower, allowing the packed shipment to be moved to the conveyor mechanism 80, such that the shipment is conveyed away from the pack station 10.

The control system logic may determine that processing of the shipment is complete when data associated with a scan code of another container is received. In some embodiments, when pack station state module 304 receives an indication of a particular container (e.g., from the agent scanning a new box for packing the next shipment) the pack station state module logic may be configured to determine that the packing agent has finished with the prior shipment and may direct the exit control mechanism (via the exit control interface) to indicate an incomplete pack state again.

Operations, such as sorting or packing operations, for example, may be performed at stations of a materials handling facility. Stations may be equipped with various features or equipment, such as scanners or other communication devices and stocked with various supplies for performing operations at the station such as packing materials, shipping containers, tape, labels, gift wrap and the like for a pack station. Sorting stations may be equipped with various communication devices, sorting bins, such as modular sorting bins that may be mobile, receptacles for moving items from and to the sorting station or the like. Various processes may be performed in steps, some of which may be sequential in nature. In some embodiments, an agent may perform the process without particular explicit instruction, while in other embodiments, an agent may receive particular and explicit instructions for performing steps of the process, from a display screen of the station, for instance.

Figure 5:
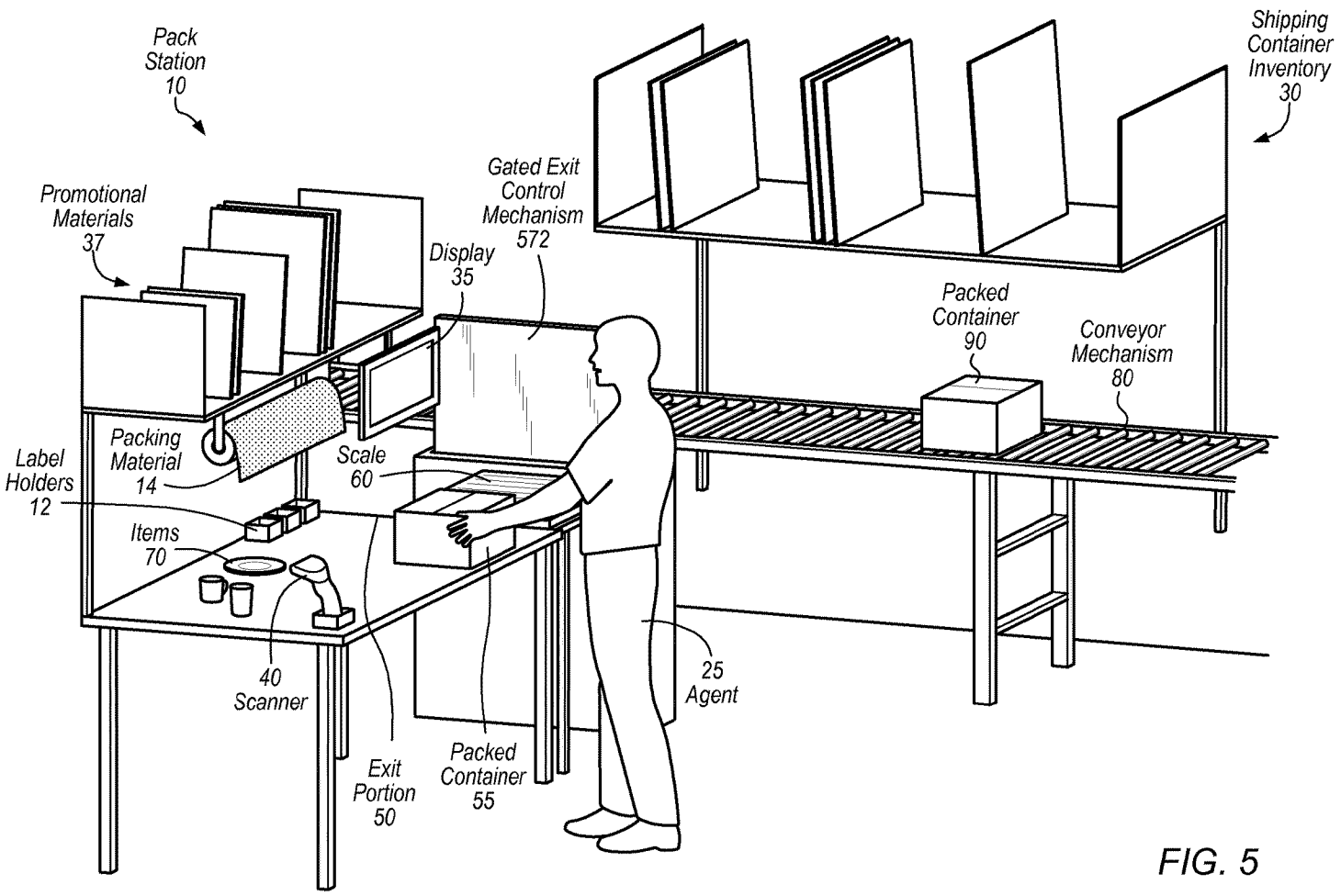
FIG. 5 illustrates a pack station with a gated exit control mechanism, according to some embodiments.

Stations (e.g., pack stations) of a materials handling facility may be configured any number of ways. A system with a pack-manager-enabled control system may interoperate with pack stations comprising numerous features such as various types of exit control mechanisms. FIG. 5 illustrates a pack station with a gated exit control mechanism, according to some embodiments. Pack station 10 illustrated in FIG. 5 has been reconfigured with respect to the illustration of pack station 10 in FIG. 1. In particular, in FIG. 5, pack station 10 is illustrated with a gated exit control mechanism 572 instead of the illuminated exit control mechanism 172, illustrated in FIG. 1. In the illustrated embodiment of FIG. 5, gated exit control mechanism 572 may indicate an incomplete pack state by rising out of the housing between the table of the pack station 10 and conveyor mechanism 80 to form a gate or wall between the pack station and the conveyor mechanism 80. Such a manner of operation may impede movement of a package from the pack station 10. When the gated exit control mechanism 572 is instructed to indicate a go pack state, the wall or gated portion of the gated exit control mechanism 572 may lower into the housing between the pack station and the conveyor mechanism 80 so as to allow the container 55 to be moved from the pack station to the conveyor mechanism 80 without interference.

Figure 6:
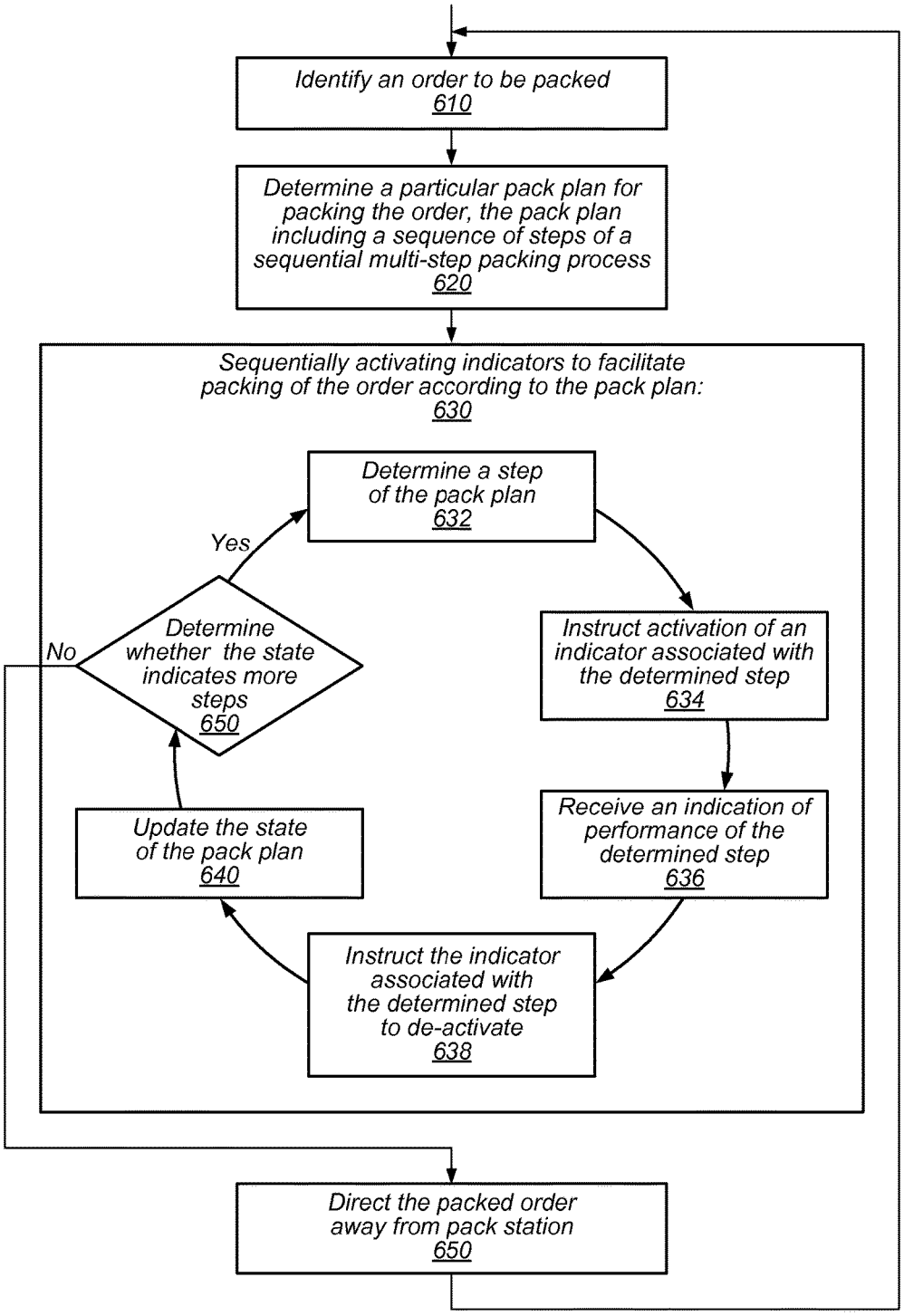
FIG. 6 illustrates a process chart describing a process for instructing performance of a sequential multi-step packing process at a pack station, according to one embodiment.

In some embodiments, cues, such as illuminated devices may be placed at, near-to, on or in a manner so as to indicate a particular device, stock, supply, operation or the like of the station to the agent. In some embodiments, the cues may be activated in a particular order, sequentially, for example. FIG. 6 illustrates a process chart describing a process for instructing performance of a sequential multi-step packing process at a pack station, according to one embodiment. In some embodiments, various component of the pack manager 305 may perform portions of the illustrated process.

At block 610, an order to be packed may be identified. For example, control system 300 may receive an indication from an order management system for, or retrieve from data store 312, an order received from a customer. The pack manager 305 may determine a sequence of steps for packing the order, in some embodiments. As indicated at block 620, a particular pack plan for packing the order may be determined; the pack plan may include a sequence of steps of a sequential, multi-step packing process. For example, the pack manager may determine what sequence to perform the following steps, the selection of the container for the shipment, which of any labels should be applied to the shipping container and when, the sequence the items should be packed into the container and the placement of packing material, or donnage into the selected shipping container.

At block 630, indicators may be activated in sequence to facilitate packing of the order according to the pack plan. In some embodiments, the sequence may correspond to, be associated with, track with or be determined from or by, the packing order of the pack plan. For example, the pack plan may include steps for selecting a shipping container, selecting and applying an identifying code to the shipping container, selecting and placing the item(s) of the order into the shipping container, adding packing material to the shipping container, adding promotional materials to the shipping container, as well as applying labels to the container. In some embodiments, some or each of these steps may be carried out as a single step illustrated in block 630. One or more of the modules of pack manager 305 may carry out the steps illustrated in block 630, in some embodiments.

In some embodiments, an indicator may convey one or more states, for example, states associated with a step of the sequential multi-step packing process. As used herein, activate and de-activate may mean that an indication device changes state, such as a light turning on or off in some embodiments. In some embodiments, activate and de-activate may mean that an indicator changes state by changing color or by physically moving, such as a gate opening or closing. Other forms of activation and de-activation are contemplated and may vary based on the capabilities of the indication device.

At block 632, a step of the pack plan may be determined, selecting a shipping container of a particular size, for example. Activation of an indicator associated with the determined step may be instructed as illustrated at block 634, by activation control module 310, for example. At block 636, an indication of performance of the determined step may be received, by data capture interface 308, for example. Block 638 illustrates that the indicator associated with the determined step may be instructed to de-activate and block 640 indicates that the state of the pack plan may be updated. In some examples, the activation control module 310 may instruct the indicator to de-activate and the pack station state model may update the state of the pack plan, based on the received indication of performance of a step, for example. The process illustrated via blocks 632-650 may be performed once, or repeated any number of times. In some embodiments the process illustrated in blocks 632-650 may be performed for each of, or for at least one of the steps of the pack plan. Decision block 650 illustrates that a determination may be made whether the state indicates more steps to be performed for the pack plan. If so, the process may return to block 632, where the next step of the pack plan is determined, and so on, as illustrated. If the state indicates that no more steps remain, the process may continue to block 650, where the packed order may be directed away from the pack station.

In some embodiments, the sequential multi-step process may include an error routine. For example, when the pack station state module 304 receives an indication that the step was not performed or was performed incorrectly, the module 304 may update the state of the pack plan to record the error. The error routine may provide feedback to the agent at the pack station 10*a* that an error has been made and may indicate a corrective action for the agent, via a display or via audio prompts, for example. In some embodiments, the error routine may include recording the state of the pack job as in an error state and the shipment may be directed to an area where correction may be performed subsequent to leaving the packing station 10*a*.

Block 650 illustrates that after the state of the pack job is updated; a determination of whether the pack job is complete may be made, in some embodiments. The determination may be made by pack station state module 304, for example, and if the pack job is determined incomplete (e.g. an error was indicated and the error routine instructs further action or additional steps from the pack plan remain) the process may return to block 632, for example. Otherwise, for pack jobs determined complete, the process may continue, as indicated at block 650, where the packed order may be directed away from the pack station.

In some embodiments, directing the packed order away from the pack station may include sending instructions to an indicator that is not necessarily indicating a step in the sequential multi-step pack process, but rather indicates a completion of the overall process. For example, the control system may instruct the illuminated exit control mechanism 172 illustrated in FIG. 1 to activate (e.g., activate the green illumination in place of the red illumination) as the direction. In another example, the control system may instruct the gated exit control mechanism 572 of FIG. 5 to activate (e.g., to lower to indicate packing is complete to an operator) such that the completed shipment can be moved to the conveyor mechanism 80. In another embodiment, another conveyor device (not illustrated) of the pack station may be activated to direct the completed package away from the pack station 10 to the conveyor mechanism 80.

In the illustrated embodiment, the process may return to 610, where an order to be packed is identified, as so on. For example, the control system may determine another order to be packed and send instructions to the pack station 10 for packing the other order.

Figure 7:
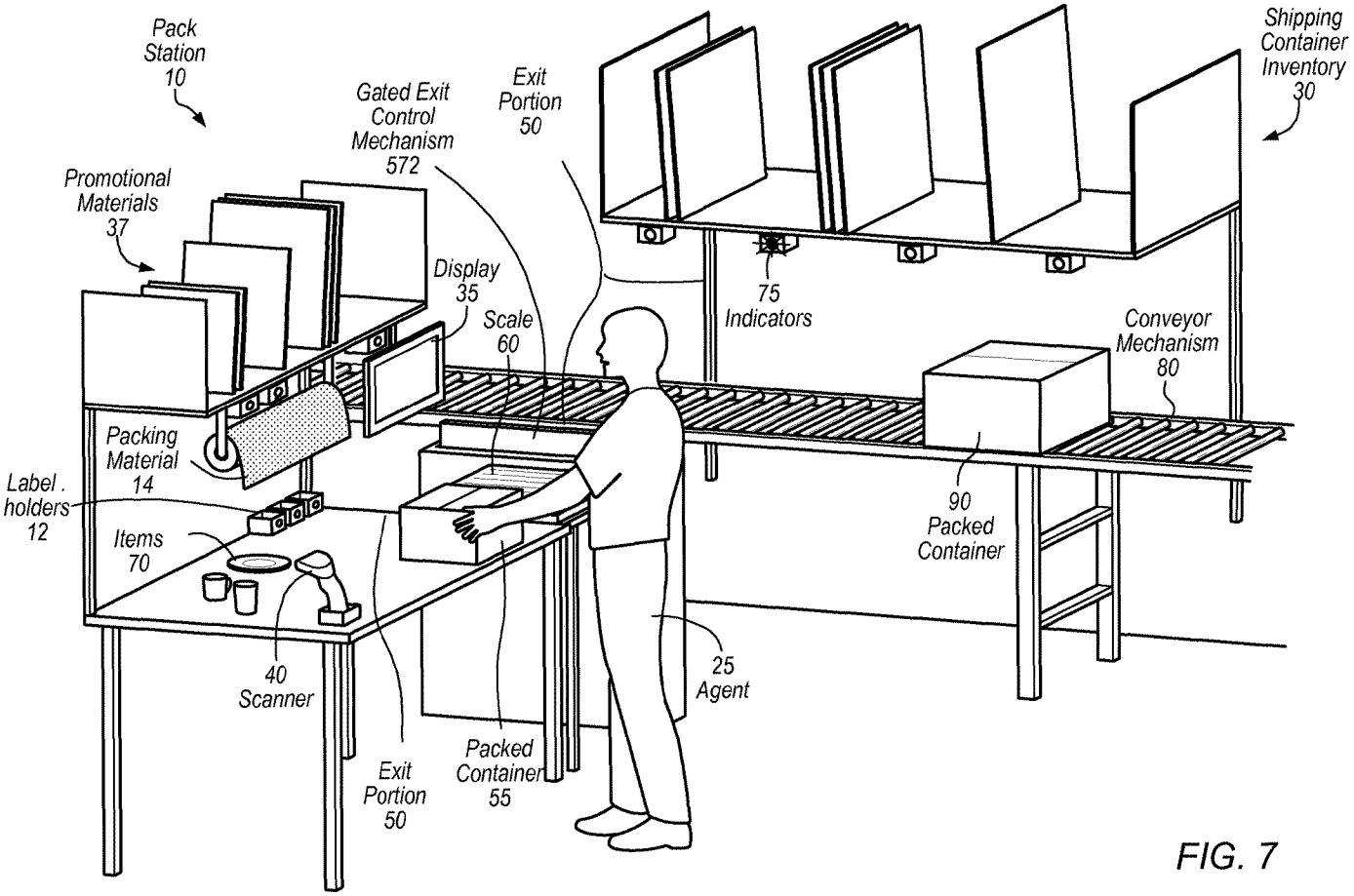
FIG. 7 illustrates a pack station configured for facilitating performance of a sequential multi-step packing process.

A materials handling facility with an indicator-enabled control system may interoperate with one or more stations comprising various types of indicators. Stations (e.g., pack stations) of a materials handling facility may be configured any number of ways. In FIG. 7, pack station 10 has been reconfigured to illustrate a pack station with indicators similar to indicator 75 at various locations throughout the pack station 10. In embodiments, indicators, such as indicator 75 may be instructed to activate so as to indicate a location associated with performing a step of a sequential multi-step packing process, such as the process illustrated in FIG. 6, for example. The illustrated indicators like indicator 75 may respond to instructions from the indicator-enabled control system by activating (e.g., illuminating themselves or by being illuminated, for example by a laser or other beam of light). In the illustrated embodiment, the indicators 75 are all of the same type, but in some embodiments, a pack station may include indicators of various types, such as lasers, LEDs, lights, reflectors, multiple-colors and the like.

In the illustrated embodiment of FIG. 7, indicators similar to indicator 75 are illustrated at four locations of the shipping container inventory 30. Each of the four indicators is illustrated located under a particular storage area of the shipping container inventory 30. In some embodiments, each of the four particular storage areas indicated by an indicator may be associated with and hold an inventory of a particular size shipping container. For example, indicator 75 of the shipping container inventory is illustrated as activated (e.g. illuminated) while the other three indicators of the shipping container inventory are not activated (e.g., not illuminated). In some embodiments, indicator 75 is associated with a shipping container selection step of the sequential multi-step packing process. For example, indicator 75 may be associated with selection of a particular size shipping container that is stored in the slot of the shipping container inventory 30 above the indicator 75.

Three other indicators, similar to indicator 75 are illustrated with the label holders 12, and one indicator each with promotional materials 37 and with packing material 14. Other pack stations may include more or fewer indicators. Indicators 75 may be located anywhere throughout the pack station 10. In embodiments, indicators 75 associate a location within the pack station with a step of a sequential multi-step process.

In FIG. 7, the three label holders 12 are illustrated with each label holder having an indicator (the round circles). The three label holders may each include labels such as warning labels, for example, fragile, liquids or explosive, and the like. As with indicator 75, each of the label indicators may be controlled or instructed by a control system to activate or de-activate. For example, a control system (e.g., control system 300) may instruct a particular one of the label indicators located on the fragile label holder to activate, thereby indicating to an operator of the pack station 10 that a fragile label is to be applied to the shipping container used to pack the items of the order.

Pack station 10 is illustrated with a single packing material 14 that has an indicator similar to indicator 75 immediately above the packing material and an indicator similar to indicator 75 below and associated with promotional materials 37. Some pack stations may be configured with more types of packing material options than illustrated in FIG. 7, each associated with their own indicator. In the illustrated embodiment of FIG. 7, the indicator above the packing material may be used to indicate a particular sequence associated with packing an order. For example, it may be desirable to place packing material into a shipping container before an item is place into the container or after an item is place into a container, or before or after promotional materials are placed into the container. A control system may instruct the indicators associated with each of the steps of a sequential multi-step packing process to activate in a sequence corresponding with the desired order of operations or steps. For example, if the desired order of the steps in the process is 1) shipping container selection, 2) packing material selection, and 3) fragile label selection and application, the control system may instruct indicator 75 to activate first, then the control system may instruct the indicator associated with the packing material 14 to activate second, and then the control system may instruct an indicator associated with the fragile label holder to activate third.

In some embodiments, the control system may instruct the prior indicator to de-activate before instructing the next indicator to activate, in response to receiving an indication from a scanner, for example. In other embodiments, the control system may instruct the set of lights associated with the steps of a particular packing process of an order to blink in a sequence corresponding to the order of the steps of the particular packing plan without waiting for the scan codes. That is, the indicators may be instructed to blink sequentially so as to convey an entire group of steps almost at once. Such a scheme may facilitate rapid packing of orders and may include reducing or eliminating entirely the number of scans required to be performed by an operator for a particular pack plan.

In some embodiments, the operator may use the scanner 40 to scan a code associated with each step of the pack process. For example, the operator may scan a code associated with the shipping container after selecting the shipping container indicated by indicator 75 and scan a code associated with the packing material 14 after packing the packing material in response to observing activation of the indicator associated with the packing material and scan a code associated with the fragile label after applying the fragile label to the container in response to observing activation of the fragile label indicator. In some embodiments, the control system may send an instruction for an indicator to de-activate after receiving a scan code associated with performance of a step associated with the scan code. In some embodiments the control system may send an instruction to activate the indicator associated with the next step in response to receiving the scan code from an indicated step.

Figure 8:
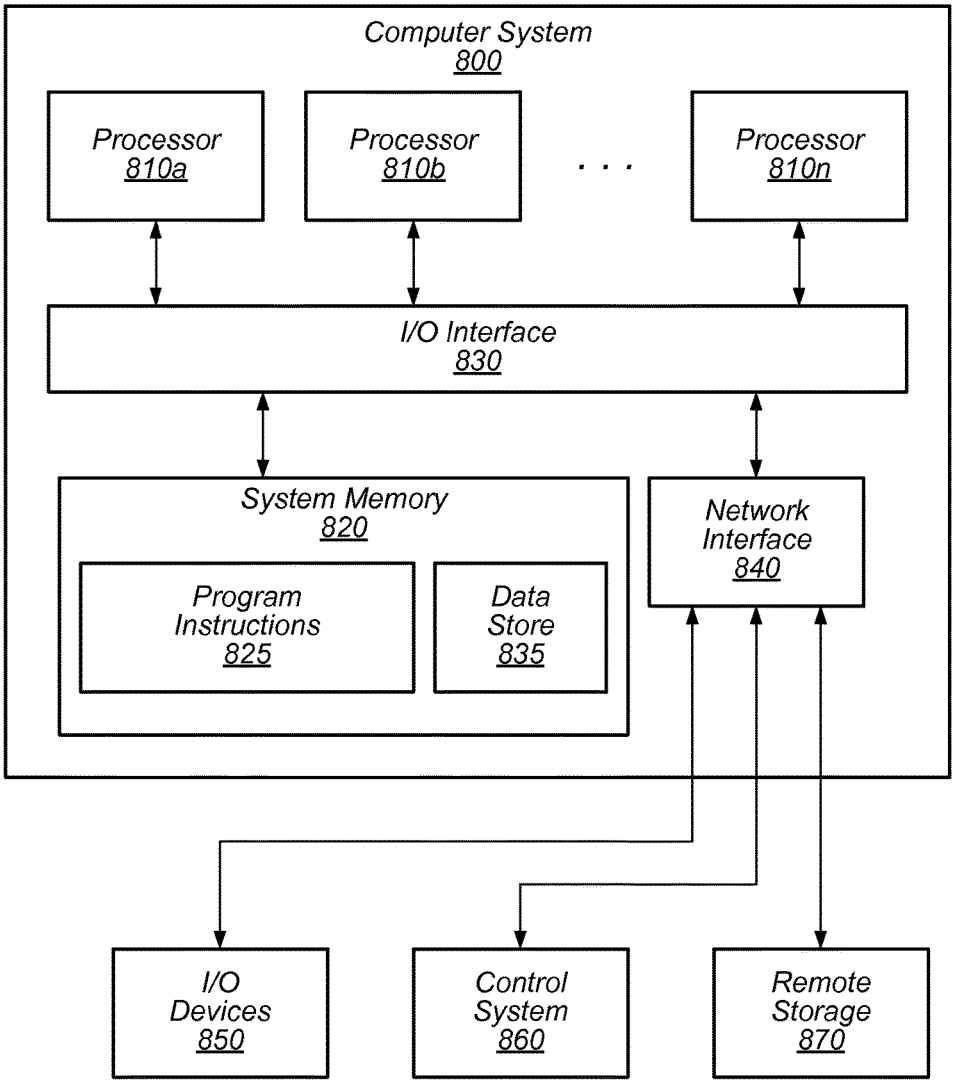
FIG. 8 is a block diagram illustrating a computer system suitable for use in various of the embodiments disclosed herein.

FIG. 8 is a block diagram illustrating a computer system suitable for use in several of the embodiments disclosed herein. Any of various computer systems may be configured to implement a system for reducing processing station errors via prominently-located off-screen indicators at processing stations within a materials handling facility. For example, FIG. 8 is a block diagram illustrating one embodiment of a computer system suitable for implementing the systems and methods described herein. In various embodiments, an indicator-enabled control system (e.g., control system 300 of FIGS. 3 and 4), a network-based enterprise (e.g., network-based enterprise 400), pack station 10, or a communication device (e.g., scanner 40 illustrated in FIG. 1) may each include a general-purpose computer system such as computer system 800 illustrated in FIG. 8.

In the illustrated embodiment, computer system 800 includes one or more processors 810 coupled to a system memory 820 via an input/output (I/O) interface 830. Computer system 800 further includes a network interface 840 coupled to I/O interface 830. In some embodiments, computer system 800 may be illustrative of control system 300, while in other embodiments control system 300 may include more, fewer, or different elements than computer system 800. In some embodiments, computer system 800 may be illustrative of control system, (e.g., 300), or a communication device (e.g., 116) while in other embodiments a control system or communication device may include more, fewer, or different elements than computer system 800.

In various embodiments, computer system 800 may be a uniprocessor system including one processor 810, or a multiprocessor system including several processors 810 (e.g., two, four, eight, or another suitable number). Processors 810 may be any suitable processors capable of executing instructions. For example, in various embodiments, processors 810 may be general-purpose or embedded processors implementing any of a variety of instruction set architectures (ISAs), such as the x86, PowerPC, SPARC, or MIPS ISAs, or any other suitable ISA. In multiprocessor systems, each of processors 810 may commonly, but not necessarily, implement the same ISA.

System memory 820 may be configured to store instructions and data accessible by processor 810. In various embodiments, system memory 820 may be implemented using any suitable memory technology, such as static random access memory (SRAM), synchronous dynamic RAM (SDRAM), non-volatile/Flash-type memory, or any other type of memory. In the illustrated embodiment, program instructions and data implementing desired functions, such as those methods and techniques described above for a network-based enterprise control system, a materials handling facility control system, or a communication device, are shown stored within system memory 820 as program instructions 825. In some embodiments, system memory 820 may include product data store 835, which may be configured as described herein (e.g., data store 312).

In one embodiment, I/O interface 830 may be configured to coordinate I/O traffic between processor 810, system memory 820 and any peripheral devices in the system, including through network interface 840 or other peripheral interfaces. In some embodiments, I/O interface 830 may perform any necessary protocol, timing or other data transformations to convert data signals from one component (e.g., system memory 820) into a format suitable for use by another component (e.g., processor 810). In some embodiments, I/O interface 830 may include support for devices attached through various types of peripheral buses, such as a variant of the Peripheral Component Interconnect (PCI) bus standard or the Universal Serial Bus (USB) standard, for example. In some embodiments, the function of I/O interface 830 may be split into two or more separate components, such as a north bridge and a south bridge, for example. Also, in some embodiments, some or all of the functionality of I/O interface 830, such as an interface to system memory 820, may be incorporated directly into processor 810.

Network interface 840 may be configured to allow data to be exchanged between computer system 800 and other devices attached to a network, such as other computer systems, for example. In particular, network interface 840 may be configured to allow communication between computer system 800 and/or various I/O devices 850. I/O devices 850 may include scanning devices, display devices and/or other communication devices, as described herein. Network interface 840 may commonly support one or more wireless networking protocols (e.g., Wi-Fi/IEEE 802.11, or another wireless networking standard). However, in various embodiments, network interface 840 may support communication via any suitable wired or wireless general data networks, such as other types of Ethernet networks, for example. Additionally, network interface 840 may support communication via telecommunications/telephony networks such as analog voice networks or digital fiber communications networks, via storage area networks such as Fibre Channel SANs, or via any other suitable type of network and/or protocol.

In some embodiments, system memory 820 may be one embodiment of a computer-accessible medium configured to store program instructions and data as described above. However, in other embodiments, program instructions and/or data may be received, sent or stored upon different types of computer-accessible media. Generally speaking, a computer-accessible medium may include computer-readable storage media or memory media such as magnetic or optical media, e.g., disk or DVD/CD-ROM coupled to computer system 800 via I/O interface 830. A computer-readable storage medium may also include any volatile or non-volatile media such as RAM (e.g. SDRAM, DDR SDRAM, RDRAM, SRAM, etc.), ROM, etc, that may be included in some embodiments of computer system 800 as system memory 820 or another type of memory. Further, a computer-accessible medium may include transmission media or signals such as electrical, electromagnetic, or digital signals, conveyed via a communication medium such as a network and/or a wireless link, such as may be implemented via network interface 840.

In some embodiments, I/O devices 850 may be relatively simple or "thin" client devices. For example, I/O devices 850 may be configured as dumb terminals with display, data entry and communications capabilities, but otherwise little computational functionality. However, in some embodiments, I/O devices 850 may be computer systems configured similarly to computer system 800, including one or more processors 810 and various other devices (though in some embodiments, a computer system 800 implementing an I/O device 850 may have somewhat different devices, or different classes of devices).

In various embodiments, I/O devices 850 (e.g., scanners or display devices, indicators and other communication devices) may include, but are not limited to, one or more of: handheld devices, devices worn by or attached to the agents, and devices integrated into or mounted on any mobile or fixed equipment of the order fulfillment facility such as pushcarts, bins, totes, racks, shelves, tables, ceilings, walls, and work benches, according to various embodiments. I/O devices 850 may further include, but are not limited to, one or more of: personal computer systems, desktop computers, rack-mounted computers, laptop or notebook computers, workstations, network computers, "dumb" terminals (i.e., computer terminals with little or no integrated processing ability), Personal Digital Assistants (PDAs), mobile phones, or other handheld devices, proprietary devices, printers, or any other devices suitable to communicate with control system 300. In general, an I/O device 850 may be any device that can communicate with control system 300 and convey instructions to agents within the facility. In one embodiment, at least some of the I/O devices 850 may be configured to scan or otherwise read or receive codes or identifiers of various components in the order fulfillment facility and to communicate the entered codes to control system 300 for use in directing agents in the various operations of the control center (e.g., bar code scanners, RFID readers, cameras, or any other sensing devices). Such components may include, but are not limited to, one or more of items, orders, modular sorting stations, modular bins, and compartments of modular bins.

The various methods as illustrated in the figures and described herein represent exemplary embodiments of methods. The methods may be implemented manually, in software, in hardware, or in a combination thereof. The order of any method may be changed, and various elements may be added, reordered, combined, omitted, modified, etc. For example, in one embodiment, the methods may be implemented by a computer system that includes a processor executing program instructions stored on a computer-readable storage medium coupled to the processor. The program instructions may be configured to implement the functionality described herein (e.g., the functionality of the control system, product database, display devices, and/or other communication devices).

Various modifications and changes may be made as would be obvious to a person skilled in the art having the benefit of this disclosure. It is intended to embrace all such modifications and changes and, accordingly, the above description to be regarded in an illustrative rather than a restrictive sense.

The invention claimed is:

1. A system, comprising:

a pack station configured for performing a multi-step packing process and comprising:

a device configured to capture data regarding completion of packing steps of the packing process;

an exit portion for moving completed packages away from the station; and an exit control mechanism located at the exit portion and configured to indicate an incomplete pack state for when a package is not yet ready to leave the pack station and a go pack state for when a package is ready to leave the pack station, wherein the location of the exit control mechanism at the exit portion of the pack station signifies that the exit control mechanism indicates when a package is ready to leave the pack station; and a control system configured to:

receive an indication of a pack job;

determine a pack plan for the pack job;

receive data indicating performance of at least some of the multiple steps of the pack job; and in response to determining that the indicated performance of multiple steps were performed in accordance with the pack plan and that the pack job is complete, instruct the exit control mechanism to indicate change from the incomplete pack state to the go pack state.

2. The system of claim 1, wherein the exit control mechanism is an illumination device, a speaker, or a mechanical device; and wherein to indicate the pack state, the control system is further configured to instruct the illumination device to change illumination, to instruct the speaker to emit a sound, or to instruct the mechanical device to impede movement of a packed container from the packing station.

3. The system of claim 1, wherein the control system is further configured to instruct the exit control mechanism to indicate the incomplete packing state prior to said receiving data indicating performance of multiple steps of the pack job.

4. The system of claim 1, further comprising a display device for displaying one or more packing instructions corresponding to at least some of the multiple steps, wherein the display device is located at a work area of the pack station distinct from the exit portion.

5. The system of claim 4, wherein the control system is further configured to send instructions to the display device instructing the display device to display the packing instructions corresponding to the packing steps of the packing process.

6. A method, comprising:

performing, by a control system having a processor and memory:

determining a pack job and corresponding pack plan for the pack job;

sending instructions corresponding to the pack plan for the pack job to a pack station;

receiving, from the pack station, data indicating performance of multiple steps for the pack job; and in response to determining that the indicated performance of multiple steps were performed in accordance with the pack plan such that the pack job is complete, sending instructions directing an exit control mechanism of the pack station to indicate that the shipment is ready to leave the pack station, wherein the exit control mechanism is located at an exit portion of the pack station for moving completed packages away from the pack station, and wherein the location of the exit control mechanism at the exit portion of the pack station signifies that the exit control mechanism indicates when a shipment is ready to leave the pack station.

7. The method of claim 6, further comprising sending instructions directing multiple steps of the pack job in accordance with the pack plan, wherein sending instructions comprises sending instructions to select a container for the pack job, sending instructions to place items in the selected container, and sending instructions to place packing material in the container.

8. The method of claim 6, further comprising:

sending an instruction directing, prior to said sending instructions corresponding to the pack plan for the pack job to a pack station, sortation of items for the pack job; and sending another instruction directing, subsequent to said sending instructions directing an exit control mechanism of the pack station to indicate that the shipment is ready to leave the pack station, the completed pack job to another area for application of a label indicating a destination for the completed pack job.

9. The method of claim 6, further comprising instructing the exit control mechanism to indicate an incomplete packing state prior to said receiving data indicating performance of multiple steps of the pack job.

10. The method of claim 6, further comprising:

determining, based on the received data, that a step of the pack plan was not performed in accordance with the pack plan for the pack job; and performing, based on the determination, an error handling routine.

11. The method of claim 10, wherein performing the error handling routine comprises:

determining an operation to perform to remedy the non-performance; and sending instructions to the pack station instructing performance of the operation.

12. The method of claim 6, further comprising receiving an indication of a weight of the package being packed, wherein said determining that the indicated performance of multiple steps were performed in accordance with the pack plan such that the pack job is complete is determined based, at least in part, upon the indicated weight of the package.

13. The method of claim 6, further comprising sending instructions to a display instructing the display to display packing instructions corresponding to the multiple steps of the pack job.

14. A pack station configured for performing a multi-step packing process, the pack station comprising:

a scanning device configured to capture data regarding completion of a plurality of packing steps of a packing plan corresponding to a pack job, wherein the scanning device is configured to send the data regarding completion of the plurality of packing steps to a control system;

an exit portion for moving completed packages away from the station; and an exit control mechanism configured to indicate a state of the pack job, wherein the exit control mechanism is located at the exit portion, wherein the location of the exit control mechanism at the exit portion of the pack station signifies that the exit control mechanism indicates when a package is ready to leave the pack station, and wherein the exit control mechanism is configured to receive instructions from the control system directing the exit control mechanism to indicate that a package is ready to leave the pack station.

15. The pack station of claim 14, wherein the exit control mechanism is configured to receive instructions from the control system instructing the exit control mechanism to indicate a go pack state, and wherein the exit control mechanism is configured to change from indicating an incomplete pack state to indicating the go pack state in response to receiving the instructions from the control system.

16. The pack station of claim 15, wherein the exit control mechanism is a gate, and wherein the received instruction to indicate the go pack state comprises an instruction directing the gate to open.

17. The pack station of claim 15, wherein the exit control mechanism is a conveyance device, and wherein the received instruction to indicate the go pack state comprises an instruction directing the conveyance device to convey the completed package from the pack station.

18. The pack station of claim 14, further comprising a display screen configured to display instructions for performing the packing steps of the packing plan, wherein the display screen is further configured to:

receive an indication of an instruction for resolving an error in performance of one of the steps of the packing plan for the pack job; and display the instruction for resolving the error.

19. The pack station of claim 14, further comprising a scale configured to obtain the weight of the package being packed, wherein the pack station is configured to send the weight of the package being packed to the control system.

20. The pack station of claim 14, further comprising a set of illumination devices at two or more locations of the pack station, wherein the illumination devices are configured to receive direction to illuminate, from a control system, such that the illumination devices illuminate in a sequence indicating a sequence of operations for the packing plan to perform at the packing station, and wherein each of the illumination devices is proximate to a physical object used in performance of one of the operations of the sequence at the pack station.

* * * * *